US011056275B2

(12) United States Patent
Kwon et al.

(10) Patent No.: US 11,056,275 B2
(45) Date of Patent: Jul. 6, 2021

(54) COIL ELECTRONIC COMPONENT

(71) Applicant: SAMSUNG ELECTRO-MECHANICS CO., LTD., Suwon-Si (KR)

(72) Inventors: Soon Kwang Kwon, Suwon-Si (KR); Young Seuck Yoo, Suwon-Si (KR); Joong Won Park, Suwon-Si (KR); Jung Wook Seo, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 201 days.

(21) Appl. No.: 16/004,843

(22) Filed: Jun. 11, 2018

(65) Prior Publication Data

US 2019/0198236 A1 Jun. 27, 2019

(30) Foreign Application Priority Data

Dec. 27, 2017 (KR) ..... 10-2017-0180447

(51) Int. Cl.

| | |
|---|---|
| ***H01F 1/34*** | (2006.01) |
| ***H01F 27/24*** | (2006.01) |
| ***H01F 27/34*** | (2006.01) |
| ***H01F 27/29*** | (2006.01) |
| ***H01F 27/28*** | (2006.01) |
| ***H01F 17/00*** | (2006.01) |

(Continued)

(52) U.S. Cl.

CPC ..... *H01F 27/34* (2013.01); *H01F 1/34* (2013.01); *H01F 17/0013* (2013.01); *H01F 27/24* (2013.01); *H01F 27/2804* (2013.01); *H01F 27/29* (2013.01); *H01F 27/292* (2013.01); *H01F 2003/106* (2013.01); *H01F 2017/0066* (2013.01); *H01F 2017/048* (2013.01); *H01F 2027/2809* (2013.01)

(58) Field of Classification Search

CPC ..... H01F 1/34; H01F 17/0013; H01F 27/24

See application file for complete search history.

(56) References Cited

U.S. PATENT DOCUMENTS 6,515,568 B1 * 2/2003 Maki ..... H01F 3/10 336/200

8,436,708 B2 5/2013 Tachibana et al.

(Continued)

FOREIGN PATENT DOCUMENTS

CN 101889319 A 11/2010

CN 103098152 A 5/2013

(Continued)

OTHER PUBLICATIONS

Office Action issued in corresponding Chinese Patent Application No. 201810908506.0 dated Oct. 12, 2020, with English translation.

*Primary Examiner* — Elvin G Enad

*Assistant Examiner* — Malcolm Barnes

(74) *Attorney, Agent, or Firm* — Morgan, Lewis & Bockius LLP

(57) ABSTRACT

A coil electronic component includes a body including ferrite, a coil portion embedded in the body, external electrodes electrically connected to the coil portion, and a magnetic permeability adjusting layer disposed in the body and including ferrite having a Curie temperature lower than that of the ferrite included in the body.

20 Claims, 5 Drawing Sheets

I - I'

(51) Int. Cl.
*H01F 3/10* (2006.01)
*H01F 17/04* (2006.01)

(56) References Cited

U.S. PATENT DOCUMENTS 9,214,263 B2 12/2015 Marusawa et al.
9,831,033 B2 11/2017 Baumann
2009/0051476 A1* 2/2009 Tada ..... H01F 17/0013 336/105
2009/0085711 A1* 4/2009 Iwasaki ..... H01F 17/04 336/234
2010/0085140 A1* 4/2010 Tanaka ..... H01F 1/344 336/221
2010/0283447 A1* 11/2010 Tachibana ..... H01F 17/0013 323/304
2011/0133881 A1* 6/2011 Nakajima ..... H01F 17/0013 336/200
2012/0268230 A1* 10/2012 Kim ..... H01F 17/04 336/200
2013/0002389 A1* 1/2013 Son ..... H01F 3/14 336/200
2013/0069752 A1* 3/2013 Kim ..... H01F 3/14 336/200
2013/0169404 A1* 7/2013 Jeong ..... H01F 3/14 336/200
2013/0182460 A1* 7/2013 Marusawa ..... H01F 1/37 363/13
2013/0249645 A1* 9/2013 Kim ..... H01F 27/292 333/175
2013/0321118 A1* 12/2013 An ..... B32B 18/00 336/212
2014/0247103 A1* 9/2014 Uchida ..... H01F 17/0013 336/200
2015/0155084 A1* 6/2015 Kim ..... H01F 41/046 174/260
2015/0318096 A1* 11/2015 Baumann ..... H01F 41/0246 335/297
2016/0217910 A1* 7/2016 Kim ..... H01F 17/0013
2016/0260539 A1* 9/2016 Koizumi ..... H01F 41/02
2017/0229223 A1* 8/2017 Okada ..... H01F 27/2804

FOREIGN PATENT DOCUMENTS

CN 105074839 A 11/2015
JP 2005-175159 A 6/2005
KR 10-2012-0045334 A 5/2012

* cited by examiner

COIL ELECTRONIC COMPONENT

CROSS-REFERENCE TO RELATED APPLICATION(S)

This application claims benefit of priority to Korean Patent Application No. 10-2017-0180447 filed on Dec. 27, 2017 in the Korean Intellectual Property Office, the disclosure of which is incorporated herein by reference in its entirety.

TECHNICAL FIELD

The present disclosure relates to a coil electronic component.

BACKGROUND

An inductor corresponding to a coil electronic component is a component constituting an electronic circuit, together with a resistor and a capacitor, and is used to remove noise or is used as a component constituting an LC resonant circuit. In this case, the inductor may be variously classified as a multilayer inductor, a winding type inductor, a thin film type inductor, or the like, depending on a form of a coil.

Recently, in accordance with a trend toward miniaturization and multifunctionalization of electronic products, miniaturization and improvement of high current characteristics of inductors have been demanded. In addition, in a high temperature environment, magnetic characteristics of ferrite, or the like, included in the inductor are changed, such that it is difficult to stably drive the inductor, a significant issue in electrical components greatly affected by heat and requiring high degrees of reliability.

SUMMARY

An aspect of the present disclosure may provide a coil electronic component capable of being stably driven by significantly decreasing a change in characteristics even in the case of a change in an environment, such as a change in temperature, or the like.

According to an aspect of the present disclosure, a coil electronic component may include: a body including ferrite; a coil portion embedded in the body; external electrodes electrically connected to the coil portion; and a magnetic permeability adjusting layer disposed in the body and including ferrite having a Curie temperature lower than that of the ferrite included in the body.

Each of the ferrite included in the body and the ferrite included in the magnetic permeability adjusting layer may be Ni—Zn—Cu-based ferrite.

A content of Zn in the Ni—Zn—Cu-based ferrite included in the magnetic permeability adjusting layer may be higher than that of Zn in the Ni—Zn—Cu-based ferrite included in the body.

The ferrite included in the magnetic permeability adjusting layer may have a magnetic permeability higher than that of the ferrite included in the body at room temperature.

The Curie temperature of the ferrite included in the magnetic permeability adjusting layer may be 80° C. to 120° C.

The Curie temperature of the ferrite included in the body may be 150° C. to 200° C.

The number of magnetic permeability adjusting layers may be plural.

Curie temperatures of ferrite included in at least two of the plurality of magnetic permeability adjusting layers may be different from each other.

The plurality of magnetic permeability adjusting layers may include a first magnetic permeability adjusting layer and a second magnetic permeability adjusting layer including ferrite having a Curie temperature higher than that of ferrite included in the first magnetic permeability adjusting layer.

The Curie temperature of the ferrite included in the first magnetic permeability adjusting layer may be 70° C. to 90° C., and the Curie temperature of the ferrite included in the second magnetic permeability adjusting layer may be 110° C. to 130° C.

The number of second magnetic permeability adjusting layers may be plural, and the first magnetic permeability adjusting layer may be disposed between the plurality of second magnetic permeability adjusting layers.

The first magnetic permeability adjusting layer may be disposed in a center of the body.

The magnetic permeability adjusting layer may be disposed in a center of the body.

The coil portion may have a structure in which a plurality of coil patterns are stacked.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Figure 1:
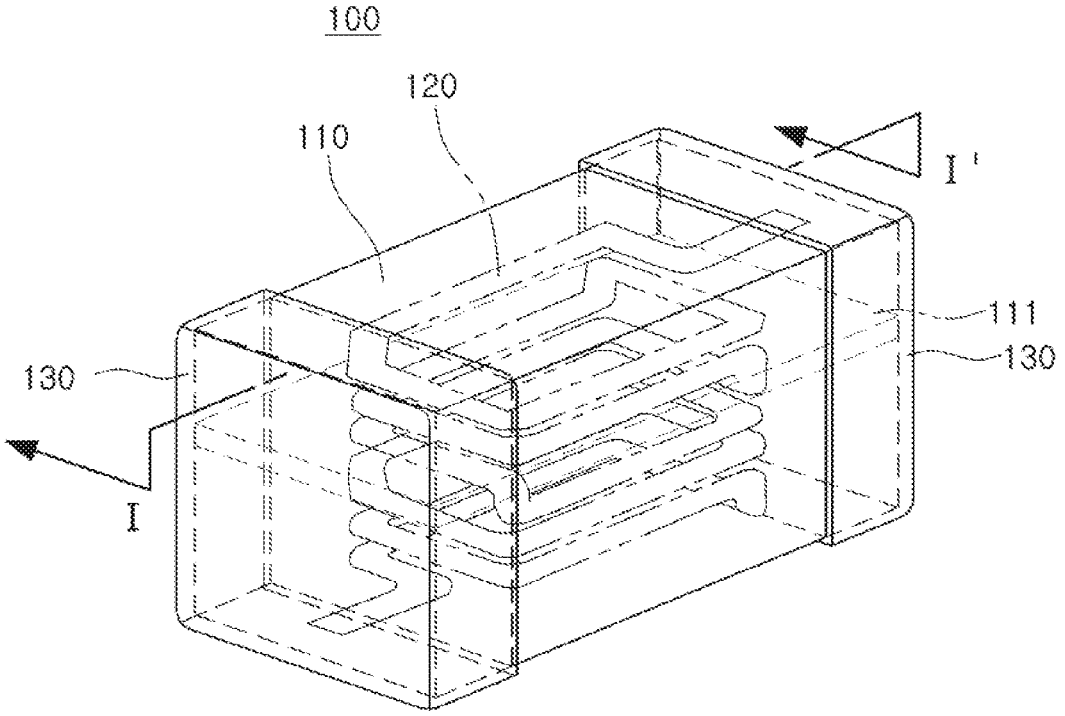
FIGS. 1 and 2 are, respectively, a schematic perspective view and a schematic cross-sectional view illustrating a coil electronic component according to an exemplary embodiment in the present disclosure.
Figure 2:
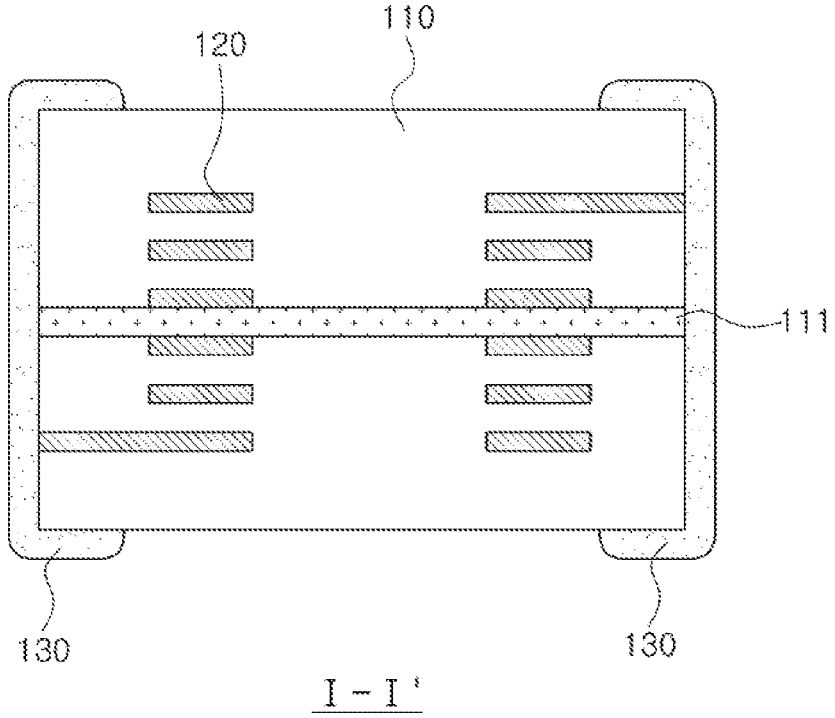

FIGS. 1 and 2 are, respectively, a schematic perspective view and a schematic cross-sectional view illustrating a coil electronic component according to an exemplary embodiment in the present disclosure.

Referring to FIGS. 1 and 2, a coil electronic component 100 may include a body 110, a coil portion 120, external electrodes 130, and a magnetic permeability adjusting layer 111 disposed in the body 110. Components of the coil electronic component 100 will hereinafter be described in detail.

The body 110 may include ferrite. The ferrite may be a material appropriate for adjusting a Curie temperature, and a typical example of the ferrite may include Ni—Zn—Cu-based ferrite. In addition, the body 110 may be configured using Mn—Zn-based ferrite, Ni—Zn-based ferrite, Mn—Mg-based ferrite, Ba-based ferrite, Li-based ferrite, or the like.

The coil portion 120 may be embedded in the body 110, and as illustrated in FIGS. 1 and 2, a plurality of coil patterns may be stacked in a thickness direction of the body 110 and be electrically connected to adjacent coil patterns to form a coil structure. The coil patterns may be formed by printing a conductive paste on magnetic layers, or the like, and may be formed of a material including, for example, silver (Ag), palladium (Pd), aluminum (Al), nickel (Ni), titanium (Ti), gold (Au), copper (Cu), platinum (Pt), or the like. In addition, the coil portion 120 may include conductive vias for electrically connecting the plurality of coil patterns to each other.

The external electrodes 130 may be formed on external surfaces of the body 110, may be electrically connected to the coil portion 120, and may be provided as a pair and be connected to one end and the other end of the coil portion 120, respectively, as illustrated in FIGS. 1 and 2. The external electrode 130 may be formed of a material having high conductivity, and may have a multilayer structure. For example, the external electrode 130 may include first and second layers. Here, the first layer may be a sintered electrode obtained by sintering a conductive paste, and the second layer may cover the first layer and include one or more plating layers. In addition, the external electrode 130 may include an additional layer, in addition to the first and second layers. For example, the external electrode 130 may include a conductive resin electrode disposed between the first and second layers to alleviate mechanical impact, or the like.

The magnetic permeability adjusting layer 111 may be disposed in the body 110, and may include ferrite having a Curie temperature lower than that of the ferrite included in the body 110. A thickness of the magnetic permeability adjusting layer 111 may be less than a thickness of the body 110. When describing properties of the body and the magnetic permeability adjusting layer, the ferrite included in the body may refer to the ferrite in the body as a whole, and the ferrite included in the magnetic permeability adjusting layer may refer to the ferrite in the magnetic permeability adjusting layer as a whole. As illustrated in FIG. 2, the magnetic permeability adjusting layer 111 may be disposed at the center of the body 110. However, a position of the magnetic permeability adjusting layer 111 may also be changed into another region of the body 110. The ferrite included in the magnetic permeability adjusting layer 111 may be Ni—Zn—Cu-based ferrite of which a Curie temperature may be adjusted depending on a content of Zn. As a temperature is increased, magnetic anisotropy of the ferrite may be decreased and an inductance of the ferrite may be increased, due to thermal vibrations. For example, a magnetic permeability of the Ni—Zn—Cu-based ferrite may be about 1200 at room temperature, but may be increased up to 3000, which is about 2.5 times the magnetic permeability at room temperature, due to a decrease in the magnetic anisotropy at 125° C. An operating temperature of electrical components may be changed from room temperature to about 120° C. to 130° C. depending on a driving condition of a vehicle. When the magnetic permeability and the inductance of the ferrite are changed depending on the operating temperature as described above, stability and reliability of a product may be decreased due to impedance matching between the components, a decrease in direct current (DC) bias characteristics depending on an increase in the inductance, or the like.

However, when the temperature is further increased to arrive at a Curie temperature, the ferrite may lose a magnetic property. In the present exemplary embodiment, such a tendency of the ferrite may be used to allow the magnetic permeability adjusting layer 111 to serve as a magnetic layer having a high-level magnetic permeability at room temperature and serve as a gap by relatively early losing a magnetic property at the time of an increase in a temperature, thereby preventing a rapid change in the magnetic permeability and inductance characteristics at a high temperature. In other words, when the temperature is increased, the magnetic permeability of the ferrite included in the magnetic permeability adjusting layer 111 is increased, but the ferrite included in the magnetic permeability adjusting layer 111 may have the Curie temperature lower than that of the ferrite included in the body 110 and thus serve as a magnetic gap at a high temperature, resulting in suppression of a rapid change in the magnetic permeability depending on the increase in the temperature.

Figure 3:
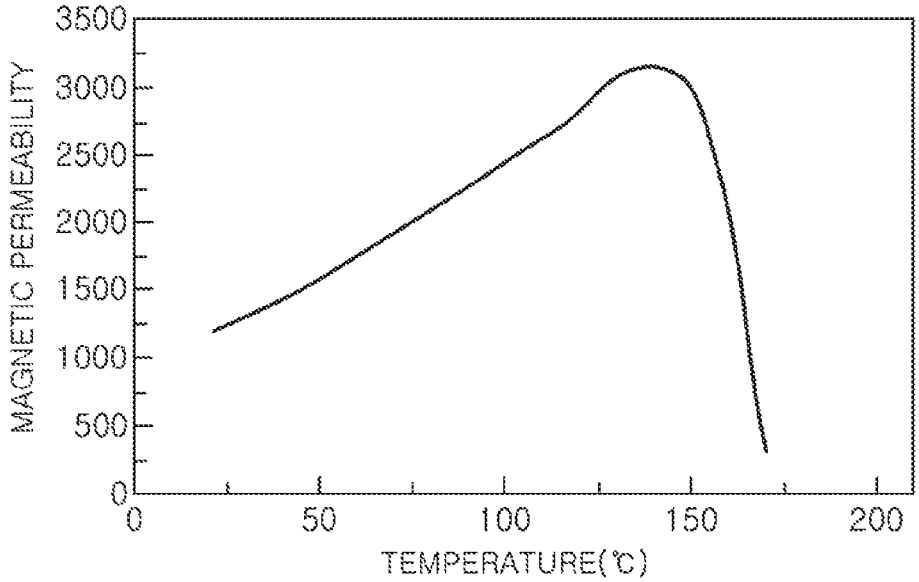
FIG. 3 is a graph illustrating magnetic permeability characteristics of ferrite included in a body, depending on a temperature.
Figure 4:
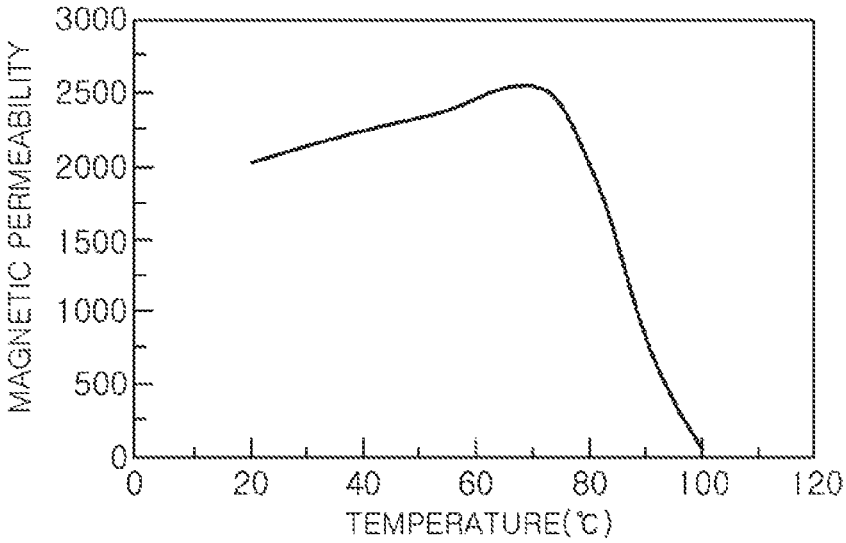
FIG. 4 is a graph illustrating magnetic permeability characteristics of ferrite included in a magnetic permeability adjusting layer, depending on a temperature.
Figure 5:
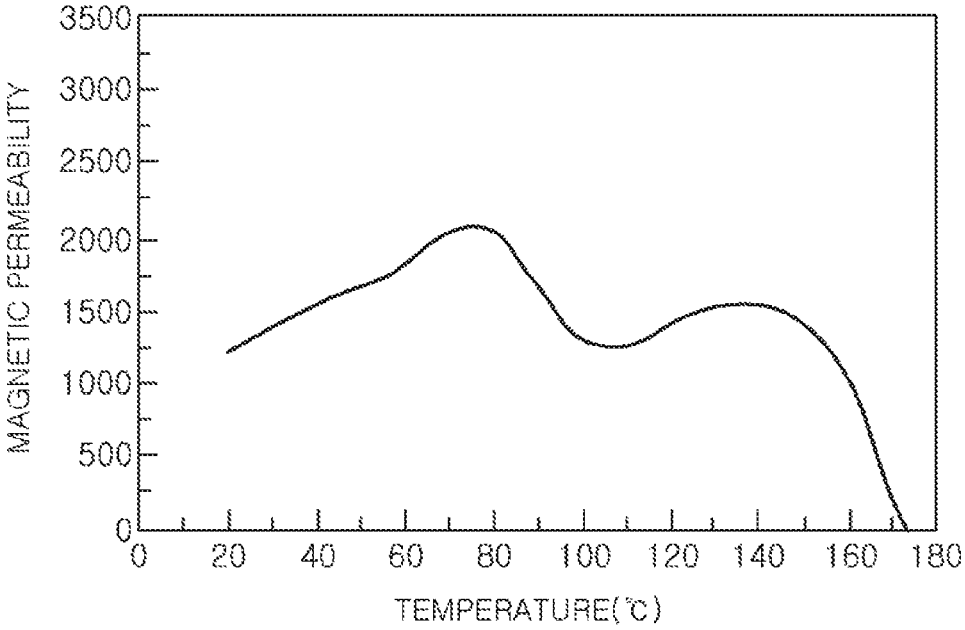
FIG. 5 is a graph illustrating magnetic permeability characteristics of an entire region of the body and the magnetic permeability adjusting layer, depending on a temperature.

FIG. 3 is a graph illustrating magnetic permeability characteristics of ferrite included in a body, depending on a temperature. FIG. 4 is a graph illustrating magnetic permeability characteristics of ferrite included in a magnetic permeability adjusting layer, depending on a temperature. FIG. 5 is a graph illustrating magnetic permeability characteristics of an entire region of the body and the magnetic permeability adjusting layer, depending on a temperature. Referring to FIGS. 3 through 5, the ferrite included in the magnetic permeability adjusting layer 111 may have a magnetic permeability higher than that of the ferrite included in the body 110 at room temperature. For example, the ferrite included in the magnetic permeability adjusting layer 111 may have a magnetic permeability of about 1800 to 2000 at room temperature, which is higher than that of the ferrite included in the body 110 at room temperature. Therefore, the ferrite included in the magnetic permeability adjusting layer 111 may not have a large influence on a change in a magnetic permeability of the coil electronic component 100 at room temperature. In addition, since the ferrite included in the magnetic permeability adjusting layer 111 has a relatively high-level magnetic permeability at room temperature, the coil electronic component 100 may secure high magnetic permeability characteristics before the ferrite included in the magnetic permeability adjusting layer 111 serves as the magnetic gap at a high temperature (the Curie temperature or higher).

The Curie temperature of the ferrite included in the body 110 may be about 150° C. to 200° C., and a case in which the Curie temperature of the ferrite included in the body 110 is 175° C. is illustrated in the graph of FIG. 3. In addition, the Curie temperature of the ferrite included in the magnetic permeability adjusting layer 111 may be about 80° C. to 120° C., and a case in which the Curie temperature of the ferrite included in the magnetic permeability adjusting layer 111 is 100° C. is illustrated in the graph of FIG. 4. The ferrite included in the magnetic permeability adjusting layer 111 may lose a magnetic property and have a magnetic permeability of 0 in the vicinity of 100° C., which is the Curie temperature, such that it becomes the magnetic gap. Therefore, as seen in the graph of FIG. 5, a rapid change in a magnetic permeability at a high temperature in the entire region may be prevented. Therefore, the coil electronic component 100 may be stably driven without a large change in magnetic characteristics even at the high temperature. Due to the stable driving characteristics described above, the coil electronic component 100 may be effectively used as the electrical component utilized in a wider temperature range, as compared to an example in which a coil electronic component having a coil portion embedded in a body but without a magnetic permeability adjusting layer.

Figure 6:
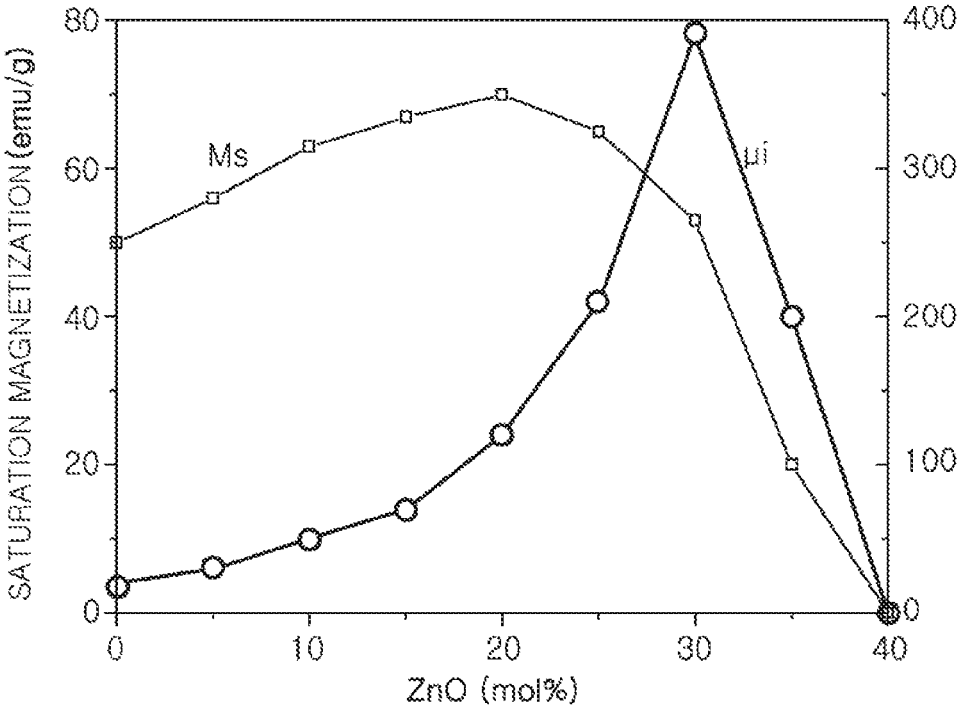
FIG. 6 shows graphs illustrating saturation magnetization Ms and magnetic permeability pi characteristics in Ni—Zn—Cu-based ferrite depending on a content of Zn.
Figure 7:
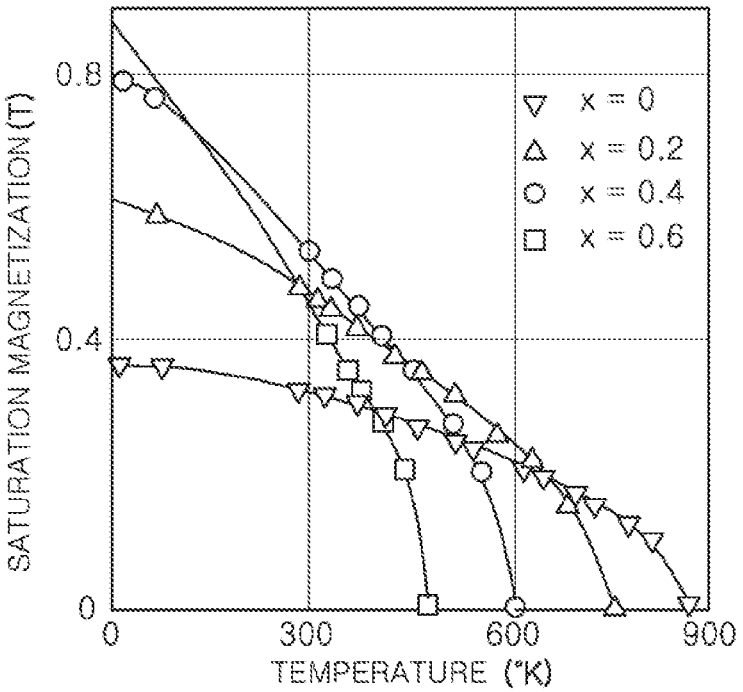
FIG. 7 shows graphs illustrating saturation magnetization and Curie temperature characteristics in Ni—Zn—Cu-based ferrite depending on a content x of Zn.

As described above, the body 110 and the magnetic permeability adjusting layer 111 may include the Ni—Zn—Cu-based ferrite, FIG. 6 shows graphs illustrating saturation magnetization Ms and magnetic permeability pi characteristics in Ni—Zn—Cu-based ferrite depending on a content of Zn, and FIG. 7 shows graphs illustrating saturation magnetization and Curie temperature characteristics in Ni—Zn—Cu-based ferrite depending on a content x of Zn. Here, as the Ni—Zn—Cu-based ferrite of FIG. 6, a sample having a composition of $Ni_{0.4}Zn_xCu_{0.11}Fe_2O_4$ and sintered at 900° C. was used. In addition, the Ni—Zn—Cu-based ferrite of FIG. 7 has a composition of $Ni_{1-x}Zn_xFe_2O_4$.

As seen in the graphs of FIGS. 6 and 7, the content of Zn in the Ni—Zn—Cu-based ferrite serves to increase a magnetic permeability at the time of being increased up to a predetermined level, but the Ni—Zn—Cu-based ferrite is vulnerable to thermal vibrations, such that a Curie temperature of the Ni—Zn—Cu-based ferrite tends to be decreased. When considering the characteristics of the Ni—Zn—Cu-based ferrite described above, the Ni—Zn—Cu-based ferrite included in the magnetic permeability adjusting layer 111 may have a composition in which a content of Zn is higher than that of Zn in a composition of the Ni—Zn—Cu-based ferrite included in the body 110.

Figure 8:
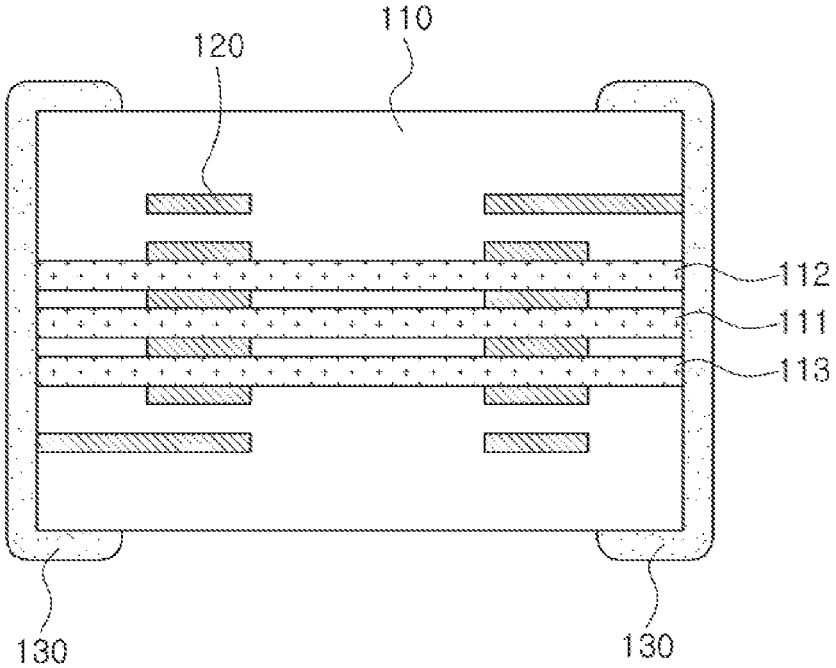
FIG. 8 is a cross-sectional view illustrating a coil electronic component according to a modified example.
Figure 9:
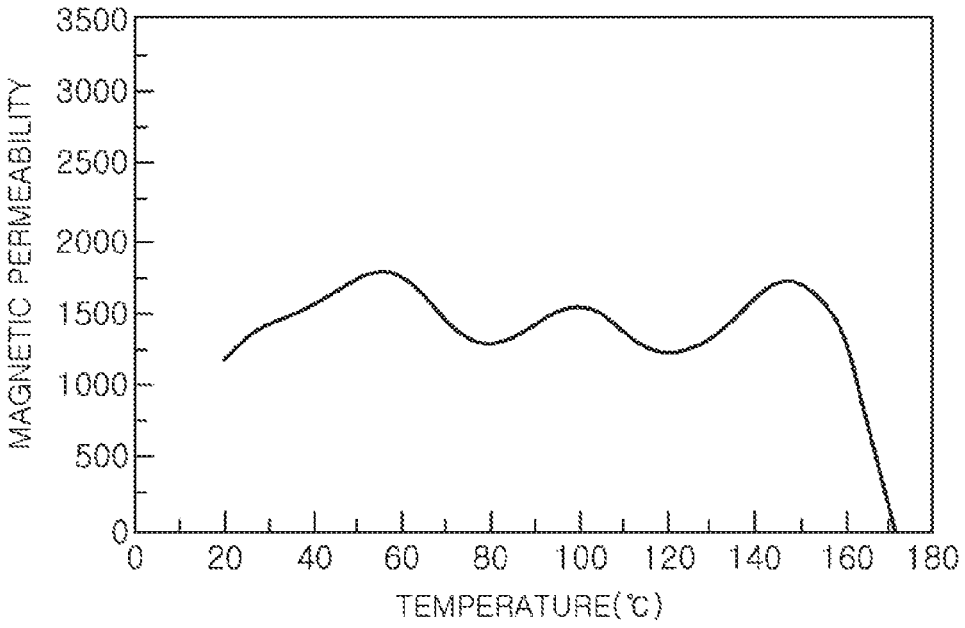
FIG. 9 is a graph illustrating magnetic permeability characteristics of an entire region of a body and a magnetic permeability adjusting layer of the coil electronic component of FIG. 8, depending on a temperature.

FIG. 8 is a cross-sectional view illustrating a coil electronic component according to a modified example. FIG. 9 is a graph illustrating magnetic permeability characteristics of an entire region of a body and a magnetic permeability adjusting layer of the coil electronic component of FIG. 8, depending on a temperature.

In the present modified example, a plurality of magnetic permeability adjusting layers 111, 112, and 113 may be disposed in the body 110, which is to make magnetic permeability characteristics uniform in a wider temperature range. In detail, Curie temperatures of ferrite included in at least two of the plurality of magnetic permeability adjusting layers 111, 112, and 113 may be different from each other, and in the present modified example, a structure in which three magnetic permeability adjusting layers 111, 112, and 113 are provided, Curie temperatures of ferrite included in two of the three magnetic permeability adjusting layers 111, 112, and 113 are the same as each other, and a Curie temperature of ferrite included in the other of the three magnetic permeability adjusting layers 111, 112, and 113 is different from the Curie temperatures is illustrated in the present modified example.

The plurality of magnetic permeability adjusting layers 111, 112, and 113 may include a first magnetic permeability adjusting layer 111 and second magnetic permeability adjusting layers 112 and 113, and a Curie temperature of ferrite included in the second magnetic permeability adjusting layers 112 and 113 may be higher than that of ferrite included in the first magnetic permeability adjusting layer 111. As an example, the Curie temperature of the ferrite included in the first magnetic permeability adjusting layer 111 may be 70° C. to 90° C., and the Curie temperature of the ferrite included in the second magnetic permeability adjusting layers 112 and 113 may be 110° C. to 130° C. In addition, as described above, the Curie temperature of the ferrite included in the body 110 may be 150° C. to 200° C. As illustrated in FIG. 8, the number of second magnetic permeability adjusting layers 112 and 113 may be plural. In this case, the first magnetic permeability adjusting layer 111 may be disposed between the plurality of second magnetic permeability adjusting layers 112 and 113. In addition, the first magnetic permeability adjusting layer 111 may be disposed in the center of the body 110. A sum of thicknesses of the plurality of magnetic permeability adjusting layers 111, 112, and 113 may be less than a thickness of the body 110.

As seen in the graph of FIG. 9 illustrating a magnetic permeability depending on a change in a temperature, the plurality of magnetic permeability adjusting layers 111, 112, and 113 having different Curie temperatures may be used to achieve gap effects in a plurality of sections in the vicinity of the Curies temperatures of the plurality of magnetic permeability adjusting layers 111, 112, and 113. Therefore, magnetic permeability characteristics of the coil electronic component 100 depending on a change in a temperature may become more uniform.

As set forth above, when the coil electronic component according to the exemplary embodiment in the present disclosure is used, a change in characteristics of the coil electronic component may be significantly decreased even in a change in an environment such as a temperature, or the like, such that the coil electronic component may be stably driven.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including ferrite;

a coil portion embedded in the body;

external electrodes connected to the coil portion; and a magnetic permeability adjusting layer disposed in the body and including ferrite having a Curie temperature lower than that of the ferrite included in the body, wherein each of the ferrite included in the body and the ferrite included in the magnetic permeability adjusting layer includes Ni—Zn—Cu-based ferrite, and the Curie temperature of the ferrite included in the magnetic permeability adjusting layer is 80° C. to 120° C.

2. The coil electronic component of claim 1, wherein a content of Zn in the Ni—Zn—Cu-based ferrite included in the magnetic permeability adjusting layer is higher than that of Zn in the Ni—Zn—Cu-based ferrite included in the body.

3. The coil electronic component of claim 1, wherein the ferrite included in the magnetic permeability adjusting layer has a magnetic permeability higher than that of the ferrite included in the body at room temperature.

4. The coil electronic component of claim 1, wherein the Curie temperature of the ferrite included in the body is 150° C. to 200° C.

5. The coil electronic component of claim 1, wherein the number of magnetic permeability adjusting layers is plural.

6. The coil electronic component of claim 5, wherein Curie temperatures of ferrite included in at least two of the plurality of magnetic permeability adjusting layers are different from each other.

7. The coil electronic component of claim 6, wherein the plurality of magnetic permeability adjusting layers include a first magnetic permeability adjusting layer and a second magnetic permeability adjusting layer including ferrite having a Curie temperature higher than that of ferrite included in the first magnetic permeability adjusting layer.

8. The coil electronic component of claim 7, wherein the number of second magnetic permeability adjusting layers is plural, and the first magnetic permeability adjusting layer is disposed between the plurality of second magnetic permeability adjusting layers.

9. The coil electronic component of claim 8, wherein the first magnetic permeability adjusting layer is disposed in a center of the body.

10. The coil electronic component of claim 8, wherein a sum of thicknesses of the first and second magnetic permeability adjusting layers is less than a thickness of the body.

11. The coil electronic component of claim 1, wherein the magnetic permeability adjusting layer is disposed in a center of the body.

12. The coil electronic component of claim 1, wherein the coil portion has a structure in which a plurality of coil patterns are stacked.

13. The coil electronic component of claim 1, wherein a thickness of the magnetic permeability adjusting layer is less than that of the body.

14. A coil electronic component comprising:

a body including ferrite;

a coil portion embedded in the body;

external electrodes connected to the coil portion; and a first magnetic permeability adjusting layer and a plurality of second magnetic permeability adjusting layers disposed in the body, wherein the first magnetic permeability adjusting layer is disposed between the plurality of second magnetic permeability adjusting layers, and the plurality of second magnetic permeability adjusting layers include ferrite having a Curie temperature higher than that of ferrite included in the first magnetic permeability adjusting layer and lower than that of the ferrite included in the body.

15. The coil electronic component of claim 14, wherein the Curie temperature of the ferrite included in the first magnetic permeability adjusting layer is 70° C. to 90° C., and the Curie temperature of the ferrite included in the plurality of second magnetic permeability adjusting layers is 110° C. to 130° C.

16. The coil electronic component of claim 14, wherein the first magnetic permeability adjusting layer is disposed in a center of the body.

17. The coil electronic component of claim 14, wherein a sum of thicknesses of the first magnetic permeability adjusting layer and the plurality of second magnetic permeability adjusting layers is less than a thickness of the body.

18. A coil electronic component comprising:

a body including ferrite;

a coil portion embedded in the body;

external electrodes connected to the coil portion; and a magnetic permeability adjusting layer disposed in the body and including ferrite having a Curie temperature lower than that of the ferrite included in the body, wherein each of the ferrite included in the body and the ferrite included in the magnetic permeability adjusting layer includes Ni—Zn—Cu-based ferrite, and the Curie temperature of the ferrite included in the body is 150° C. to 200° C.

19. The coil electronic component of claim 18, wherein a content of Zn in the Ni—Zn—Cu-based ferrite included in the magnetic permeability adjusting layer is higher than that of Zn in the Ni—Zn—Cu-based ferrite included in the body.

20. The coil electronic component of claim 18, wherein the ferrite included in the magnetic permeability adjusting layer has a magnetic permeability higher than that of the ferrite included in the body at room temperature.

* * * * *